US006216521B1

(12) United States Patent
Heymes et al.

(10) Patent No.: US 6,216,521 B1
(45) Date of Patent: Apr. 17, 2001

(54) PROCESS FOR IMPROVING THE PLANENESS OF A METAL SHEET

(75) Inventors: Fabrice Heymes, Saint Marcellin; Michel Garbil, Issoire; Vincent Hochenedel, Grenoble, all of (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 09/358,929

(22) Filed: Jul. 23, 1999

(30) Foreign Application Priority Data

Aug. 24, 1998 (FR) ..... 98 10739

(51) Int. Cl.[7] ..... B21D 25/00
(52) U.S. Cl. ..... 72/302
(58) Field of Search ..... 72/302, 301, 297, 72/296

(56) References Cited

U.S. PATENT DOCUMENTS 3,552,175 1/1971 Kinnavy .
5,579,658 12/1996 Noe et al. ..... 72/302

FOREIGN PATENT DOCUMENTS

1452957 * 4/1971 (DE) ..... 72/302
697619 1/1931 (FR) .
1179089 1/1970 (GB) .
2066120 7/1981 (GB) .
264322 * 3/1970 (RU) ..... 72/302
278612 * 8/1970 (RU) ..... 72/302

* cited by examiner

*Primary Examiner*—Daniel C. Crane
(74) *Attorney, Agent, or Firm*—Dennison, Scheiner, Schultz & Wakeman

(57) ABSTRACT

Process for improving planeness of a metal sheet, in which the sheet is stretched between two jaws for a period of time, applying a controlled permanent elongation of greater than 0.5%. Transverse pressure is applied on at least one face of the sheet during at least part of the period time during which stretching is applied with at least one longitudinally movable roll, or with a metal bar clamped to an opposite face of the sheet.

12 Claims, 1 Drawing Sheet

PROCESS FOR IMPROVING THE PLANENESS OF A METAL SHEET

FIELD OF THE INVENTION

This invention relates to a process for improving the planeness of metal sheets by stretching, and particularly high strength aluminum alloy sheets.

DESCRIPTION OF RELATED ART

Industrial manufacturing of metal sheets usually results in planeness defects despite all precautions taken, which cause expensive internal scrap in order to respect standards and specifications in force in this field. For example, these defects may consist of a general deformation of the sheet, called "camber" when this deformation is a longitudinal curvature about an axis perpendicular to the rolling direction, and "transverse bow" when it is a curvature about an axis parallel to the rolling direction, using the terms in European standard EN 485-3. Deformation may also be local, either in a particular area of the sheet, or concentrated at one or several vertices, which for example may be measured. It may concern "wavy edges" when one edge of the sheet is longer than the central part, or corrugations originating from rolling. Standards known to the expert in the field specify planeness tolerances as a function of the thickness, particularly by defining a total maximum deflection over the length or width or over a chord with a minimum length. For example, this is the case in European standard EN 485-3 (October 1993 edition) for hot rolled aluminum alloy sheets, and standard EN 485-4 (October 1993 edition) for cold rolled aluminum alloy sheets.

The operation to improve planeness consists of stretching the sheet or the strip, causing plastic deformation of the metal that elongates the shortest fibers. There are two frequently used techniques for correcting these defects: leveling by rolls, and stretching. Leveling by rolls consists of passing the sheet between two series of parallel rolls placed alternately below and above the sheet, the rolls being nested. The strip or sheet is then alternately deflected in one direction and then in the other to obtain plastic deformation. Roll leveling machines cannot completely correct planeness defects unless these defects are not too severe; in the case of thick sheets with high mechanical properties, the leveling effect that can be obtained in this way is often insufficient, or even non-existent, particularly after quenching. This is why there are hardly any machines that can accept sheets more than 25 or 30 mm thick.

There are several variant roll leveling machines in which the sheet remains fixed and the rolls, mounted on a mobile cage, move together with respect to the sheet. Thus, U.S. Pat. No. 3,552,175 defines a technique for leveling metal strips using at least three rolls placed alternately above and below the strip, which ensures that the strip which is fixed at both ends and is tensioned, is deflected at all locations at least once alternately in one direction and then in the other, each deflection leading to permanent elongation. In this technique, permanent elongation is the result of deflection obtained by the effect of the rolls, and not by stretching applied to the ends of the strip. Examples deal with very thin strips (between 0.08 and 0.13 mm), and it is doubtful that this technique could be applied to rolled aluminum alloy products with a significantly greater thickness.

Patent GB 1 179 089 describes a machine that is a combination between a stretcher and a low power rolling mill. After tensioning the steel strip to its yield strength, the rolling mill is made to pass from one end of the strip to the other. This technique does not lead to a significant permanent elongation.

Tension consists of stretching the plate, the ends of which are trapped between two jaws, to apply a permanent controlled elongation of a few percent to it. This technique is used particularly for thick sheets. The stretching machine comprises a fixed head with jaws and a mobile head comprising the other jaws. The efficiency of this technique is not satisfactory in some cases, and particularly in the case of quenched sheets. For example, for heat treated aluminum alloy sheets, in other words alloys in the 2000, 6000 and 7000 series using the designation of the Aluminum Association, it is well known that the quenching operation induces significant deformations and therefore a strong transverse bow effect, in addition to dispersed and random planeness defects; this does not disappear easily during stretching.

Patent GB 2 066 120 describes a technique for leveling metal sheets that consists of a combination between leveling by rolls and stretching. A relative movement between the sheet fixed between two jaws at the ends, and a set of parallel leveling rolls placed alternately below and above the sheet, subjects the plate to the leveling effect by rolls and by applied stretching, each of which results in a permanent deformation beyond the yield strength of the material, in a different manner. Nevertheless, this device is more like a tensioned leveling machine using nested leveling rolls, than stretching by tension. The permanent deformation of the sheet obtained using this technique is very low, of the order of 0.1 to 0.2% per leveling pass since it is obtained mainly by the bending effect on nested leveling rolls, since the contribution of stretching is low. The sheet or strip is fixed at each end in jaws rigidly attached to a fixed head, the set of leveling rolls being displaced with respect to the fixed heads, or at one of its ends in jaws fixed to a mobile head that moves with respect to the group of leveling rolls.

In many cases, the improvement in planeness is not the only objective of applying stretching to the sheet. Permanent cold deformation of a sheet or strip improves some mechanical properties, particularly the yield strength, and relaxes internal stresses caused by quenching, which is particularly important for thick sheets intended to be machined. In this case, the deformation must be carried out in a very controlled manner in order to obtain a product with reproducible characteristics, which is easier with a stretcher than with a roll leveling machine, at least in the case of medium and thick sheets.

Therefore, there are three major disadvantages with the technique described in Patent GB 2 066 120; since the stretching force is simply equal to the resistance to be overcome to pull the sheet through a set of leveling rolls, the contribution of stretching to the total deformation is difficult to control and remains too low to significantly improve some mechanical properties of the sheet, and it cannot sufficiently eliminate some planeness defects and internal stresses induced by quenching sheets.

Furthermore, some standards require that controlled stretching is applied to the sheet; for example, standard EN 2126 specifies controlled stretching between 1.5% and 3% for the manufacture of 7075 alloy sheets (using the designation of the Aluminum Association) in T651 temper (as defined in EN 515) with a thickness of between 6 and 80 mm. This process requirement cannot be satisfied using a roll leveling machine or the device described in Patent GB 2 066 120.

SUMMARY OF THE INVENTION

Thus, the purpose of the invention is to improve the planeness of metal sheets, and particularly quenched metal sheets, and particularly to eliminate transverse bow effects and local deformations along the longitudinal or transverse direction due to quenching.

Its purpose is a process for improving the planeness of metal sheets consisting of stretching the metal by tension between two jaws until a permanent controlled elongation of more than 0.5% is achieved, and preferably more than 1% and even better more than 1.5%, and maintaining a transverse pressure on at least one of the faces of the sheet, at least during part of the time that this stretching is applied.

The invention also relates to different methods of applying this transverse pressure:

- rolls transversely applied with pressure on at least one of the faces of the sheet, and subject to an application force onto the sheet,
- "anti-bow" bars consisting of a metal bar transversely applied with pressure on one of the faces of the sheet and held in contact with this face under pressure by means of clamps applied with pressure on the other face,
- a combination of the above two means,
- one or several rolls of the type described above, moving longitudinally along one face of the sheet during stretching. Displacement may be continuous or it may be made incrementally.

Another purpose of the invention is aluminum alloy sheets, and particularly work hardened sheets or sheets that have been heat treated by solution treating and quenching. For sheet thicknesses exceeding 50 mm, the total deflection divided by the length measured as defined in standard EN 485-3 (October 1993 edition) is still less than 0.10%, and usually less than 0.05% of the length of the sheet, and the total deflection divided by the width is always less than 0.15%, and usually less than 0.10% of the width of the sheet. The total deflection, also measured as defined in standard EN 485-3 for a chord length l of at least 300 mm, is always less than 0.25 l, and usually less than 0.15 l.

For sheet thicknesses of between 6 and 50 mm, the total deflection divided by the length measured according to standards EN 485-3 and 485-4 (October 1993) is always less than 0.15%, and usually less than 0.10% of the length of the sheet. The total deflection divided by the width is always less than 0.30% and usually less than 0.20% of the width of the sheet. The local deflection measured according to standards EN 485-3 and 485-4 for a chord length l equal to at least 300 mm, is always less than 0.20 l, and usually less than 0.15 l.

For sheet thicknesses of less than 6 mm, the total deflection divided by the length measured according to standards EN 485-3 and 485-4 (October 1993) is always less than 0.20%, and usually less than 0.15% of the length of the sheet. The total deflection divided by the width is always less than 0.35% and usually less than 0.30% of the width of the sheet. The local deflection measured according to standards EN 485-3 and 485-4 for a chord length l equal to at least 300 mm, is always less than 0.30 l, and usually less than 0.20 l.

DESCRIPTION OF THE PREFERRED EMBODIMENTS

Figure 1:
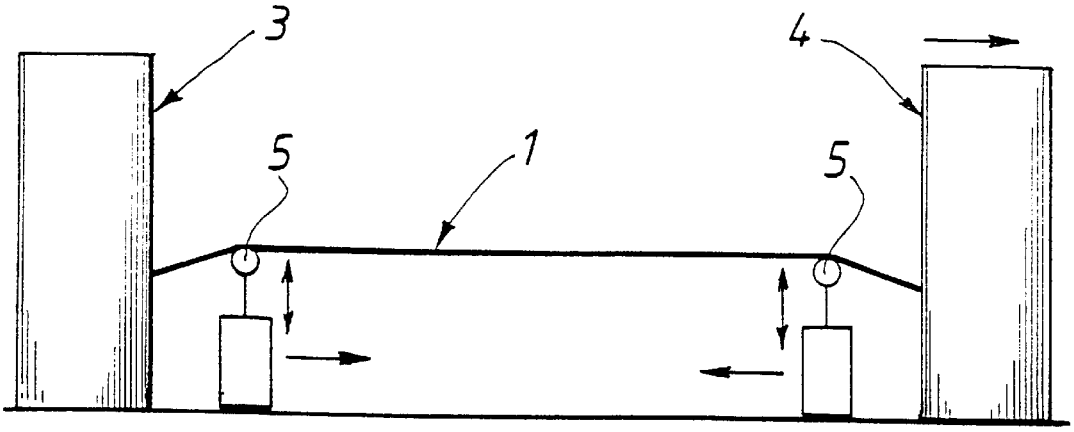
FIG. 1 shows a diagram of a tension stretching installation fitted with two pressure rolls.
Figure 2:
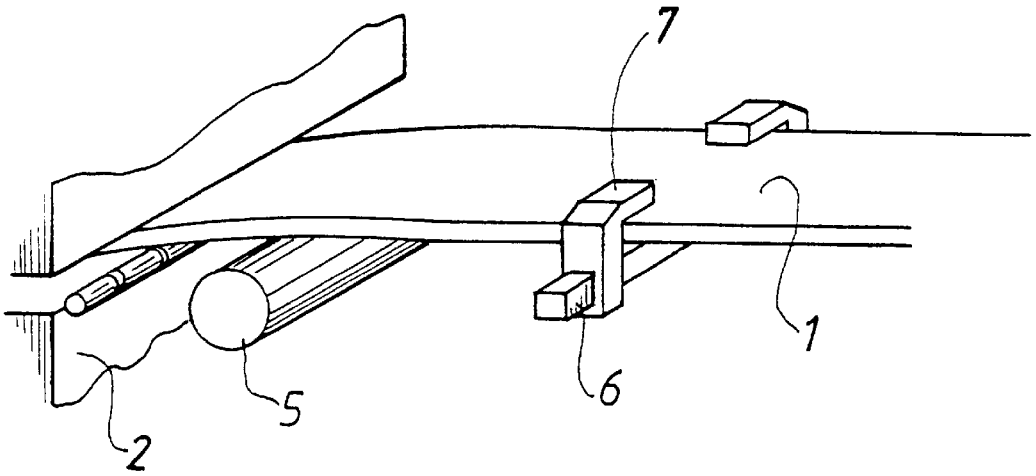
FIG. 2 shows a perspective view of a sheet stretched with a pressure roll and an "anti-bow" bar.

The thick metal sheets are usually leveled using a stretcher as shown in FIGS. 1 and 2, in which the two ends of the sheet (1) are clamped in jaws (2), one of the jaws being fixed to a fixed head (3) and the other fixed to a mobile head (4). Displacement of the mobile head (4) elongates the sheet, often by the order of 1.5 to 3%. The applicant has observed that this operation, although it can very much reduce some planeness defects such as camber, is insufficient to reduce other defects and particularly transverse bow effects induced by quenching, to an acceptable level conform with standards.

A first preferred embodiment of the invention as shown in FIG. 1 consists of providing one or several transverse pressure rolls (5) on the lower side of the sheet (1). These rolls are pushed in contact with the sheet with a force exerted vertically upwards and adjusted using an appropriate device such as a hydraulic jack, with a variable pressure P. The rolls may be lowered when stretching is almost finished in order to terminate stretching without them and thus avoid the deformation that they may induce on the sheet (and which is shown in an exaggerated manner in FIG. 1). The force applied by the roll(s) onto the sheet may be applied at the beginning of stretching, or preferably gradually after reaching a certain elongation of the sheet.

The applicant has observed that use of a single roll can already improve planeness compared with prior art, but that a better result is obtained with two or more rolls. The fact that rolls are applied on the upper surface of the sheet makes no difference to the result; it makes the device more flexible, but also more complex.

Another preferred embodiment of the invention shown in FIG. 2 consists of placing one or several "anti-bow" bars composed of a metal bar (6) forced into contact with the lower surface of the sheet by clamps (7) on the upper surface of the sheet, while a tension is applied. Depending on the defects to be corrected, the bars are installed on the upper face, on the lower face or on both faces. A particularly efficient means of reducing the bow effect consists of combining these two embodiments, for example by inserting several anti-bow bars between the two rolls.

A third preferred embodiment consists of using one or several rolls of the type described above, making them longitudinally mobile, in order to cover the majority of the underside of the sheet. The mobile roll may be moved discontinuously, for example by breaking the tension into several steps and moving the roll between each step. It may also be continuous throughout the stretching operation, except towards the end of the operation when the rolls are lowered completely, before the end of elongation by stretching. This solution usually gives the best results. In doing this, it is desirable to coordinate the longitudinal displacement and application pressure with control of the stretcher and the nature of the alloy. A cambered roll may advantageously be used for thicker sheets and/or harder alloys, for example with a curvature inverse to the curvature of the bow effect to be corrected.

EXAMPLES

Example 1

A 7788×1896×25.4 mm sheet made of 6061 aluminum alloy (using the designation of The Aluminum Association) with a chemical composition (% by weight) of approximately Si=0.7, Fe=0.3, Cu=0.25, Mn=0.08, Mg=1.0, Cr=0.2, Zn=0.15 was made by semi-continuous casting of a sheet, homogenization, hot rolling and quenching by water spraying. A positive transverse bow (concave upwards) of between 14.5 and 29.5 mm was measured along the sheet. Simple stretching was then applied to the sheet according to prior art, with no additional anti-bow device added to produce an elongation of 2.1%, and a positive transverse bow (concave upwards) of between 1.8 and 11 mm was observed. This maximum value of 11 mm is outside the maximum tolerance allowed by standard EN 485-3 which is 0.4% of the width, or 7.6 mm.

Example 2

Three 60.1×1290×8449 mm sheets made of 7075 alloy were made and quenched under the same conditions. Their camber measured over 2400 mm was of the order of 5 mm. Stretching was applied to the first sheet to produce a permanent elongation of 2.2%, without the addition of any other device. Stretching was applied to the second sheet to 2.1% with the addition of 2 anti-bow bars. Stretching was applied to the third sheet to 2.2%, and two fixed rolls were used in addition to the two anti-bow bars. The bow (in mm) was measured every meter along the length. The results are shown in table 1, the various values of $t_i$ corresponding to the 8 measurement points.

TABLE 1

| Sheet No. | $t_1$ | $t_2$ | $t_3$ | $t_4$ | $t_5$ | $t_6$ | $t_7$ | $t_8$ |
|---|---|---|---|---|---|---|---|---|
| 1 | 1.5 | 2.4 | 2.1 | 2.0 | 1.2 | 1.0 | 0 | 0.5 |
| 2 | 0.8 | 0.8 | 1.2 | 1.1 | 0.8 | 0.5 | 0 | 0 |
| 3 | 0 | 0 | 0 | 0 | 0 | 0 | 0 | 0 |

After stretching, the camber measured over a length of 2000 mm was 2 mm for the first and second sheets, and 1 mm for the third.

Example 3

A sheet made of the same alloy and the same size as the sheet in example 1 had a positive transverse bow after quenching of between 4 and 24 mm for the part located between 0 and 6150 mm from one side, a W-shaped corrugation close to dimension 6150 mm and a negative transverse bow (concave downwards) of between 2.5 and 7 mm over the rest of the sheet.

Stretching was applied in four successive steps:

the first step to an elongation of 0.3% using two pressure rolls located at dimensions 1650 and 6150 mm respectively, the second step to an elongation of 0.9%, after having moved the first roll from dimension 1650 mm to dimension 2975 mm, a third step up to 1.6% elongation after having moved the first roll to dimension 4350 mm, the fourth step up to 2% elongation without the rolls.

The measurement of the final planeness shows a positive transverse bow over the entire sheet of between 1 and 2.8 mm, with a very significant reduction in defects at locations at which the rolls were applied. The mobility of the rolls results in better planeness than can be obtained with fixed rolls, or even a combination of fixed rolls and anti-bow bars.

Example 4

Stretching tests were carried out on six identical 7793×1593×23.05 mm quenched sheets made of a 6061 alloy, using various anti-bow devices, and the planeness was measured before and after stretching.

1) The first sheet had a positive transverse bow after quenching of between 8.5 and 19 mm. After stretching to produce up to 2% elongation without any anti-bow device, a positive transverse bow of between 1.8 and 11 mm was obtained, which is outside the tolerances in standard EN 485-3.

2) After quenching, the second sheet had a positive transverse bow of between 5.2 and 18.5 mm. The stretching test with an elongation of up to 2% was then carried out using two fixed rolls at 1650 mm from the stretching jaws and four anti-bow bars uniformly distributed between the rolls. The transverse bow after stretching was limited to 1 mm, except close to the jaws where it was of the order of 2 mm.

3) The third sheet had a positive transverse bow after quenching of between 4.6 and 17.5. The stretching test to an elongation of 2.5% was carried out using a fixed roll at 1600 mm from the mobile head of the stretcher, and a roll that was continuously mobile over a distance of 1600 mm towards the mobile head, starting from a distance of 1650 mm from the fixed head. The contact pressure of the mobile roll on the sheet was 7 MPa. The maximum transverse bow after stretching was 1.8 mm.

4) The fourth sheet had a positive transverse bow after quenching of between 7 and 19 mm. The stretching test to 2.4% elongation was carried out under the same conditions as in the previous case, except that the displacement of the mobile roll was 1900 mm and the contact pressure of this mobile roll varied between 4.5 MPa at the beginning of the test and 3.5 MPa at the end of the test. After stretching, the transverse bow was less than 0.7 mm except close to the jaws and in the area not affected by the mobile roll where it was 1.5 mm.

5) The fifth sheet had a positive transverse bow after quenching of between 8 and 19 mm. The stretching test up to an elongation of 2.5% was carried out under the same conditions as above, except that the displacement of the mobile roll was 2000 mm and that the thrust pressure was modified from 5 MPa at the beginning to 3.5 MPa at the end. The transverse bow after stretching was less than 0.6 mm, except close to the jaws and in the area not covered by the mobile roll, where it was 1.9 mm.

6) The sixth sheet had a positive transverse bow after quenching of between 7 and 19 mm. The stretching test up to an elongation of 2.3% was carried out as above with a mobile roll moving over 2150 mm. The thrust pressure of the mobile roll fluctuated between 3 and 5.5 MPa. The maximum transverse bow after stretching was 2.2 mm.

The camber was also measured on the six sheets over a length of 2400 mm before and after stretching. The camber after quenching and before stretching varied between 60 and 70 mm, and after stretching it varied between 1 and 2 mm.

These tests show that excellent planeness can be obtained with fixed devices, provided that they are combined with rolls and anti-bow bars. They also show that the best results are obtained with a mobile roll, since practically zero transverse bow can be obtained in the area covered by the roll, provided that the pressure exerted on the roll is controlled during its movement.

Example 5

Two 10×1335×7899 mm sheets made of 7010 alloy were manufactured and quenched under the same conditions. After quenching, the transverse bow on each was of the order of 10 mm and the camber measured over 2400 mm was of the order of 50 mm. Stretching was then applied to the two sheets up to a permanent elongation of 2%, the first without any particular device, the second with 7 transverse thrust devices (bars and rolls). The transverse bow (in mm) was then measured every 50 cm. The results are shown in table 2, in which references 1 to 18 on the first line correspond to the tiles $t_1$ at the various measurement points.

TABLE 2

| No. | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 1 | 2.5 | 2.8 | 3.8 | 4.2 | 5.5 | 6.1 | 6.3 | 5.6 | 5.8 | 6.0 | 6.5 | 6.5 | 6.3 | 6.2 | 6.2 | 4.2 | 3.3 | 2.4 |
| 2 | 2.2 | 1.8 | 1.8 | 1.8 | 1.6 | 1.6 | 1.5 | 1.2 | 1.1 | 1.2 | 1.2 | 1.4 | 0.9 | 0.8 | 0.9 | 1.5 | 1.6 | 1.0 |

It can be seen that the addition of anti-bow devices can reduce the maximum transverse bow from 6.5 to 2.2 mm. Furthermore, the camber measured over a length of 2400 mm is less than 0.3 mm for the first sheet and less than 0.2 mm for the second sheet.

Example 6

Two identical 5×1200×6557 mm sheets made of 2024 alloy were made and quenched under identical conditions. After quenching, the sheets had complex deformations and the amplitude of the deflections exceeded 20 mm. Stretching was applied to the first sheet to an elongation of 1.9% with no special device. After stretching it had a transverse bow of 10 mm and a camber of 6 mm measured over 1200 mm.

Stretching was applied to the second sheet to an elongation of 2.7% using five transverse thrust devices (bars and rolls). The transverse bow measured after stretching was 3.5 mm, and the measured camber was 2.5 mm over 2000 mm.

What is claimed is:

1. Process for improving planeness of a metal sheet, comprising stretching the sheet between two jaws for a period of time, applying a controlled permanent elongation of greater than 0.5%, and maintaining transverse pressure on only one face of the sheet during at least part of the period time during which stretching is applied with at least one longitudinally movable roll.

2. Process according to claim 1, wherein said controlled permanent elongation is greater than 1%.

3. Process according to claim 2, wherein the controlled permanent elongation is greater than 1.5%.

4. Process according to claim 1, wherein the at least one roll is cambered.

5. Process according to claim 1, wherein the pressure applied by the at least one roll on the sheet is applied gradually after a predetermined elongation of the sheet has been achieved.

6. Process according to claim 1, wherein the at least one roll is separated from the sheet before termination of stretching.

7. Process according to claim 1, additionally comprising applying transverse pressure to the sheet with metal bars.

8. Process according to claim 1, wherein the sheet comprises an aluminum alloy.

9. Process according to claim 8, wherein the sheet is a work hardened sheet.

10. Process according to claim 9, wherein the sheet is a heat treated and quenched sheet.

11. Process for improving planeness of a metal sheet, comprising stretching the sheet between two jaws for a period of time, applying a controlled permanent elongation of greater than 0.5%, and maintaining transverse pressure on at least one face of the sheet during at least part of the period time during which stretching is applied with at least one metal bar held in contact with the face on which pressure is applied by means of clamps applied with pressure on an opposite face of the sheet.

12. Process according to claim 11, wherein at least one bar is placed in contact with both faces of the sheet.

* * * * *